US011848183B2

(12) United States Patent
Wysocki et al.

(10) Patent No.: US 11,848,183 B2
(45) Date of Patent: Dec. 19, 2023

(54) ION CARPET-BASED SURFACE-INDUCED DISSOCIATION DEVICES AND METHODS

(71) Applicant: Ohio State Innovation Foundation, Columbus, OH (US)

(72) Inventors: Vicki Wysocki, Columbus, OH (US); Joshua Gilbert, Columbus, OH (US); Alyssa Stiving, Columbus, OH (US)

(73) Assignee: Ohio State Innovation Foundation, Columbus, OH (US)

( * ) Notice: Subject to any disclaimer, the term of this patent is extended or adjusted under 35 U.S.C. 154(b) by 235 days.

(21) Appl. No.: 16/727,454

(22) Filed: Dec. 26, 2019

(65) Prior Publication Data

US 2020/0273687 A1 Aug. 27, 2020

Related U.S. Application Data

(60) Provisional application No. 62/811,301, filed on Feb. 27, 2019.

(51) Int. Cl.
*H01J 49/00* (2006.01)
*H01J 49/06* (2006.01)

(52) U.S. Cl.
CPC ..... *H01J 49/0068* (2013.01); *H01J 49/062* (2013.01)

(58) Field of Classification Search
CPC ..... H01J 49/0068; H01J 49/062
See application file for complete search history.

(56) References Cited

U.S. PATENT DOCUMENTS 5,026,987 A * 6/1991 Bier ..... H01J 49/0068 250/281
2009/0014639 A1* 1/2009 Bateman ..... B82Y 30/00 250/281
2013/0120894 A1* 5/2013 van Amerom ..... H01J 49/066 361/230
2014/0224974 A1* 8/2014 Kenny ..... H01J 49/26 250/282

OTHER PUBLICATIONS

Zhou et al., Surface-Induced Dissociation of Ion Mobility-Separated Noncovalent Complexes in a Quadrupole/Time-of-Flight Mass Spectrometer, Analytical Chemistry. 84: 6016-23 (2012) (Year: 2012).*

(Continued)

*Primary Examiner* — David A Vanore
(74) *Attorney, Agent, or Firm* — Meunier Carlin & Curfman LLC

(57) ABSTRACT

Devices and methods for surface-induced dissociation (SID) are disclosed. In one aspect, a device for SID is disclosed which, in one embodiment includes a collision surface, a deflector configured to guide precursor ions from a pre-SID region to the collision surface to cause SID, and an ion carpet having applied electrical properties configured to guide product ions resulting from collision with the collision surface to a post-SID region. In another aspect, a method for SID is disclosed which, in one embodiment includes guiding, by a deflector, precursor ions from a pre-SID region to a collision surface to cause SID, and guiding, by an ion carpet having selected applied electrical properties, product ions resulting from collision with the collision surface to a post-SID region.

15 Claims, 7 Drawing Sheets
(5 of 7 Drawing Sheet(s) Filed in Color)

(56) References Cited

OTHER PUBLICATIONS

Zhou, Mowei, Chengsi Huang, and Vicki H. Wysocki. "Surface-induced dissociation of ion mobility-separated noncovalent complexes in a quadrupole/time-of-flight mass spectrometer." Analytical chemistry 84.14 (2012): 6016-6023 (Year: 2012).*

Anthony, S. N.; Shinholt, D. L.; Jarrold, M. F. A Simple Electrospray Interface Based on a DC Ion Carpet. International Journal of Mass Spectrometry 2014, 371, 1-7. https://doi.org/10.1016/j.ijms.2014.06.007.

Benesch, J. L. P.; Robinson, C. V. Mass Spectrometry of Macromolecular Assemblies: Preservation and Dissociation. Curr. Opin. Struct. Biol. 2006, 16, 245-251.

Busch, F.; VanAernum, Z. L.; Ju, Y.; Yan, J.; Gilbert, J. D.; Quintyn, R. S.; Bern, M.; Wysocki, Vicki H. Localization of Protein Complex Bound Ligands by Surface-Induced Dissociation High-Resolution Mass Spectrometry. Analytical Chemistry 2018, 90, 12796-12801.

Dongre, A. R.; Jones, J. L.; Somogyi, A.; Wysocki, Vicki H. Influence of Peptide Composition, Gas-Phase Basicity, and Chemical Modification on Fragmentation Efficiency: Evidence for the Mobile Proton Model. J. Am. Chem. Soc. 1996, 118 (35), 8365-8374.

Galhena, A. S.; Dagan, S.; Jones, C. M.; Beardsley, R. L.; Wysocki, V. H. Surface-Induced Dissociation of Peptides and Protein Complexes in a Quadrupole/Time-of-Flight Mass Spectrometer. Anal. Chem. 2008, 80, 1425-1436.

Harvey, S. R.; Seffernick, J. T.; Quintyn, R. S.; Song, Y.; Ju, Y.; Yan, J.; Sahasrabuddhe, A. N.; Norris, A.; Zhou, M.; Behrman, E. J.; et al. Relative Interfacial Cleavage Energetics of Protein Complexes Revealed by Surface Collisions. Proc Natl Acad Sci USA 2019, 116 (17), 8143-8148. https://doi.org/10.1073/pnas.1817632116.

Jo, S.- C.; Cooks, R. G. Translational to Vibrational Energy Conversion during Surface-Induced Dissociation of n-Butylbenzene Molecular Ions Colliding at Self-Assembled Monolayer Surfaces. Eur J Mass Spectrom (Chichester) 2003, 9 (4), 237-234. https://doi.org/10.1255/ejms.554.

Laskin, J.; Futrell, J. H. Energy Transfer in Collisions of Peptide Ions with Surfaces. J. Chem. Phys. 2003, 119 (6), 3413-3420. https://doi.org/10.1063/1.1589739.

Meroueh, O.; Hase, W. L. Dynamics of Energy Transfer in Peptide-Surface Collisions. J. Am. Chem. Soc. 2002, 124 (7), 1524-1531. https://doi.org/10.1021/ja011987n.

Niu, S.; Ruotolo, B. T. Collisional Unfolding of Multiprotein Complexes Reveals Cooperative Stabilization upon Ligand Binding. Protein Sci 2015, 24 (8), 1272-1281. https://doi.org/10.1002/pro.2699.

Postawa, Z.; Czerwinski, B.; Szewczyk, M.; Smiley, E. J.; Winograd, N.; Garrison, B. J. Enhancement of Sputtering Yields Due to C60 versus Ga Bombardment of Ag{111} as Explored by Molecular Dynamics Simulations. Anal. Chem. 2003, 75(17), 4402-4407. https://doi.org/10.1021/ac034387a.

Pratihar, S.; Barnes, G. L.; Laskin, J.; Hase, W. L. Dynamics of Protonated Peptide Ion Collisions with Organic Surfaces: Consonance of Simulation and Experiment. J. Phys. Chem. Lett. 2016, 7 (16), 3142-3150. https://doi.org/10.1021/acs.jpclett.6b00978.

Quintyn, R. S.; Yan, J.; Wysocki, V. H. Surface-Induced Dissociation of Homotetramers with D2 Symmetry Yields Their Assembly Pathways and Characterizes the Effect of Ligand Binding. Chem. Biol. 2015, 22, 583-592.

Robinson, C. V.; Sali, A.; Baumeister, W. The Molecular Sociology of the Cell. Nature 2007, 450 (7172), 973-982. https://doi.org/10.1038/nature06523.

Sharon, M. How Far Can We Go with Structural Mass Spectrometry of Protein Complexes? J Am Soc Mass Spectrom 2010, 21 (4), 487-500. https://doi.org/10.1016/j.jasms.2009.12.017.

Shirzadeh, M.; Boone, C. D.; Laganowsky, A.; Russell, D. H. Topological Analysis of Transthyretin Disassembly Mechanism: Surface-Induced Dissociation Reveals Hidden Reaction Pathways. Anal. Chem. 2019, 91 (3), 2345-2351. https://doi.org/10.1021/acs.analchem.8b05066.

Snyder, D. T.; Panczyk, E.; Stiving, A. Q.; Gilbert, J. D.; Somogyi, A.; Kaplan, D.; Wysocki, V. H. Design and Performance of a Second-Generation Surface-Induced Dissociation Cell for Fourier Transform Ion Cyclotron Resonance Mass Spectrometry of Native Protein Complexes. Analytical Chemistry. 91(21): 14049-14057 https://doi.org/10.1021/acs.analchem.9b03746.

VanAernum, Z. L.; Gilbert, J. D.; Belov, M. E.; Makarov, A. A.; Horning, S. R.; Wysocki, Vicki H. Surface-Induced Dissociation of Noncovalent Protein Complexes in an Extended Mass Range Orbitrap Mass Spectrometer. Analytical Chemistry 2019, 91, 3611-3618. https://doi.org/10.1021/acs.analchem.8b05605.

Vimer, S.; Ben-Nissan, G.; Morgenstern, D.; Quintyn, R. S.; Wysocki, V. H.; Sharon, M. Multilevel Analysis of Ortholog Protein Complexes by Native Mass Spectrometry. Manuscript submitted.

Wang, Y.; Hase, W. L.; Song, K. Direct Dynamics Study of N-Protonated Diglycine Surface-Induced Dissociation. Influence of Collision Energy. J Am Soc Mass Spectrom 2003, 14(12), 1402-1412. https://doi.org/10.1016/j.jasms.2003.08.014.

Williams, E. R.; Fang, L.; Zare, R. N. Surface Induced Dissociation for Tandem Time-of-Flight Mass Spectrometry. International Journal of Mass Spectrometry and Ion Processes 1993, 123, 233-241.

Yan, J.; Zhou, M.; Gilbert, J. D.; Wolff, J. J.; Somogyi, A.; Pedder, R. E.; Quintyn, R. S.; Morrison, L. J.; Easterling, M. L.; Pasa-Tolić, L.; et al. Surface-Induced Dissociation of Protein Complexes in a Hybrid Fourier Transform Ion Cyclotron Resonance Mass Spectrometer. Anal. Chem. 2017, 89, 895-901.

Zhou, M.; Dagan, S.; Wysocki, V. H. Protein Subunits Released by Surface Collisions of Noncovalent Complexes: Nativelike Compact Structures Revealed by Ion Mobility Mass Spectrometry. Angew. Chem. 2012, 124 (18), 4412-4415. https://doi.org/10.1002/ange.201108700.

* cited by examiner

ION CARPET-BASED SURFACE-INDUCED DISSOCIATION DEVICES AND METHODS

CROSS-REFERENCE TO RELATED APPLICATIONS

This Application claims priority to, and benefit under 35 U.S.C. § 119(e) of, U.S. Provisional Patent Application No. 62/811,301, filed Feb. 27, 2019, which is hereby incorporated by reference herein in its entirety.

STATEMENT REGARDING GOVERNMENT SUPPORT

This invention was made with government support under grant number GM128577 awarded by the National Institutes of Health and grant number 1455654 awarded by the National Science Foundation. The government has certain rights in the invention.

BACKGROUND

Surface-induced dissociation (SID) is a fragmentation technique utilized within mass spectrometry (MS) that has found particular utility in the field of native MS. Native MS involves the study of proteins and protein complexes in the gas phase. SID is one activation method used within tandem MS experiments that has proven useful in interrogating the connectivity and topology of biologically-relevant protein complexes.

Native MS utilizes soft ionization techniques to enable the transfer of these macromolecules into the gas phase while retaining their noncovalent interactions and preserving a folded, native-like structure (e.g., kinetically trapping a solution-like structure with interfaces intact). Once the macromolecular complex is in the gas phase, MS is capable of providing details about molecular weight, stoichiometry, and ligand binding. ([2-3]). A wide range of activation methods have been utilized within tandem MS to probe the substructures of protein complexes, the most common activation method being collision-induced dissociation (CID). CID involves accelerating ions through a neutral background gas; the ions undergo a stepwise build-up of internal energy, which typically culminates in restructuring of the complex and subsequent ejection of an unfolded, highly-charged monomer, leaving behind its complementary (n−1) mer ([4]). Despite the utility of CID (and its variant collision-induced unfolding) in elucidating stoichiometric and gas-phase stability information, ([5]) this restructuring can lead to a loss in information about the connectivity between subunits.

SID involves accelerating an ion (or ions) of interest into a surface in order to deposit a high amount of energy by collision with the high mass surface. This process allows access to alternative dissociation pathways that are otherwise not achievable using common, commercially-available techniques such as collision induced dissociation (CID) which involves numerous low-energy collisions with a neutral background gas. The alternative pathways accessed by SID have proven to be useful in characterizing the topology of protein complexes, consistently dissociating noncovalent proteins in patterns reflective of their native structure. Subcomplexes or subunits produced by SID are compact and retain native-like structure. These subcomplexes also retain a symmetrical portion of the charge from the original precursor ion which confirms the structure has not been perturbed as by CID. The appearance energy at which various subcomplexes or subunits are released has been shown to be reflective of the original native structure, allowing for discrimination between different computational models or correlation with a single model of the topology/connectivity of the intact protein complex.

Additionally, SID has proven useful in identifying ligand localization within a protein complex, an area that is of particular interest to pharmaceutical companies because of its relevance to candidate drug binding studies. Information obtained previously from analysis of protein complexes by SID has been used to obtain structural information about complexes from low sample amounts in fast experiments, providing information that is complementary or able to guide already-existing technology such as NMR or cryo-EM. Thus, the utility of this technique makes commercialization desirable. The use of SID for comparison with crystal structures is an excellent use case, as crystal structures can reflect changes from the solution structure during the crystal growing process. SID has also demonstrated utility in elucidating the substructure of noncovalent protein complexes. SID involves accelerating ions into a rigid surface. Although computational modeling of the SID process has been performed for molecules up to the size of small peptides and C60, computational models of SID do not exist for large protein complexes. ([7-9]). It has been shown experimentally that the interaction time at the surface is short (picoseconds for ions below m/z 300), ([10]) that energy deposition depends on the softness/hardness of the surface, ([8,9,11]) and that higher-mass projectiles require higher acceleration energies to induce dissociation. ([12]). Additionally, SID of protein complexes cleaves weaker interfaces at lower energies producing subcomplexes that are indicative of the connectivity and topology of the intact protein complex, ([13-14]) that have charge distributions that are distributed symmetrically to products upon SID of homo-oligomers, ([6]) and can that retain ligand in binding pockets or at surfaces by SID, ([3]) in contrast to the restructuring and asymmetrical charging that is typical for multi-step CID. ([4]).

The ability to efficiently manipulate ions within a mass spectrometer is key to developing tools such as SID. A challenge in the case of in-line SID, which keeps the SID device in-line with a typically linear mass selection device (e.g., a quadrupole) and ion mobility and/or other activation method such as CID, is the requirement to radially focus and bring ions back on-axis after the surface collision. Conventionally, this may be accomplished using a series of independently-controlled DC lenses without the use of RF for radial confinement.

Existing designs for some SID devices are implemented within commercially-available instruments by modifying them in-house to fit the SID cell by the truncation or removal of an ion guide. These existing designs can have limitations. For example, the product ion collection efficiency is less than optimal. Because many "real world" protein complex samples are not available in high quantities, conservation of signal is important even after fragmentation has occurred. One advantage of using mass spectrometry within the field of structural biology is the ability to use small amounts of sample (microliter volumes, nanomolar to micromolar concentrations), but the signal obtained from these small quantities must be conserved as well as possible. One existing SID device design has 10 independent lenses that require an independent power supply and despite its advantages in elucidating topology and connectivity information about noncovalent protein complexes, this existing DC-only device can result in non-optimal mass-dependent and energy-dependent tuning requirements. These limitations can also prevent the use of SID within online LC-MS separations experiments, a popular technique in high-throughput experiments. As another limitation, the usability of some existing devices across a wide range of user experience is limited because tuning is challenging for the non-expert. A large number of lenses (e.g., 10) to be tuned is a limitation in usability, but operation may also not be intuitive in many existing devices, proving a challenge in keeping the technology operational within outside labs. It is with respect to these and other considerations that the various embodiments described below are presented.

SUMMARY

In some aspects, the present disclosure relates to devices and methods for surface-induced dissociation (SID).

In one aspect, the present disclosure relates to a device for surface-induced dissociation (SID) which, in one embodiment, includes: a collision surface; a deflector configured to guide precursor ions from a pre-SID region to the collision surface to cause SID; and an ion carpet having applied electrical properties configured to guide product ions resulting from collision with the collision surface to a post-SID region.

In one embodiment, the ion carpet includes a plurality of concentric rings that include an outermost ring having a first selected direct current (DC) voltage and an innermost ring having a second, different selected DC voltage, to generate a voltage gradient and guide the product ions to the post-SID region. The plurality of concentric rings are resistively coupled.

In one embodiment, the ion carpet has a central opening defined by the concentric rings, through which the guided product ions exit the device.

In one embodiment, the ion carpet is configured as part of a titled surface ion carpet (TSIC) surface-induced dissociation device.

In one embodiment, the deflector is an angled deflector lens.

In one embodiment, wherein the angled deflector lens is configured with at least a portion thereof having a semicircular shape.

In one embodiment, the deflector has applied electrical properties selected to cause the precursor ions to be repelled from the deflector and guided towards the collision surface.

In one embodiment, the collision surface has applied electrical properties selected to attract the precursor ions.

In one embodiment, the precursor ions correspond to small molecules, lipids, fatty acids, peptides, sugars, metabolites, oligomers, nucleotides, polymers, or natural or designed and synthetic variants of the molecular classes.

In one embodiment, the precursor ions correspond to proteins, protein complexes, protein-small molecule complexes, RNA, DNA, protein-RNA complexes, protein-DNA complexes, lipid nanodiscs, antibodies, antibody-drug conjugates, DNA complexes, RNA complexes, viruses, fungi, or bacteria.

In another aspect, the present disclosure relates to a device for surface-induced dissociation (SID) which, in one embodiment includes: a tilted collision surface; an angled deflector lens configured to guide precursor ions from a pre-SID region to the collision surface to cause SID; and an ion carpet ion carpet having a plurality of rings with a selected applied direct current (DC) voltage gradient and configured to guide product ions, resulting from collision with the collision surface, to a post-SID region, wherein the plurality of rings are resistively coupled.

In one embodiment, the plurality of rings include concentric rings including an outermost ring having a first selected direct current (DC) voltage and an innermost ring having a second, different selected DC voltage, to generate the voltage gradient and guide the product ions to the post-SID region.

In one embodiment, the ion carpet has a central opening through which the guided product ions exit the device. The central opening is defined by the concentric rings.

In one embodiment, the angled deflector lens is configured with at least a portion thereof having a semicircular shape.

In one embodiment, the angled deflector lens has applied electrical properties selected to cause the precursor ions to be repelled from the deflector and guided towards the collision surface.

In one embodiment, the collision surface has applied electrical properties selected to attract the precursor ions.

In one embodiment, the precursor ions correspond to small molecules, lipids, fatty acids, peptides, sugars, metabolites, oligomers, nucleotides, polymers, or natural or designed and synthetic variants of the molecular classes.

In one embodiment, the precursor ions correspond to proteins, protein complexes, protein-small molecule complexes, RNA, DNA, protein-RNA complexes, protein-DNA complexes, lipid nanodiscs, antibodies, antibody-drug conjugates, DNA complexes, RNA complexes, viruses, fungi, or bacteria.

In another aspect, the present disclosure relates to a method for surface-induced dissociation (SID). In one embodiment, the method includes: guiding, by a deflector, precursor ions from a pre-SID region to a collision surface to cause SID; and guiding, by an ion carpet having selected applied electrical properties, product ions resulting from collision with the collision surface to a post-SID region.

In one embodiment, the ion carpet includes a plurality of concentric rings including an outermost ring and an innermost ring. The method can also include applying a first selected direct current (DC) voltage to the outermost ring and applying a second, different selected DC voltage to generate a voltage gradient. The concentric rings are resistively coupled.

In one embodiment, the method include guiding, using the ion carpet, the product ions through a central opening to exit the device, wherein the central opening is defined by the concentric rings.

In one embodiment, the deflector is an angled deflector lens configured with at least a portion thereof having a semicircular shape.

In one embodiment, the method includes applying selected electrical properties to the deflector to cause the precursor ions to be repelled from the deflector and guided towards the collision surface.

In one embodiment, the method includes applying selected electrical properties to the collision surface to attract the precursor ions.

In one embodiment, the precursor ions correspond to small molecules, lipids, fatty acids, peptides, sugars, metabolites, oligomers, nucleotides, polymers, or natural or designed and synthetic variants of the molecular classes.

In one embodiment, the precursor ions correspond to proteins, protein complexes, protein-small molecule complexes, RNA, protein-RNA complexes, protein-DNA complexes, lipid nanodiscs, antibodies, antibody-drug conjugates, DNA complexes, RNA complexes, viruses, fungi, or bacteria.

Other aspects and features according to the example embodiments of the present disclosure will become apparent to those of ordinary skill in the art, upon reviewing the following detailed description in conjunction with the accompanying figures.

BRIEF DESCRIPTION OF THE DRAWINGS

The patent or application file contains at least one drawing executed in color. Copies of this patent or patent application publication with the color drawing(s) will be provided by the Office upon request and payment of the necessary fee. Reference will now be made to the accompanying drawings, which are not necessarily drawn to scale.

FIGS. 1A-1C show schematics and components of a device implementing a tilted surface with ion carpet (TSIC) in accordance with one embodiment of the present disclosure, wherein: FIG. 1A shows a perspective view of a TSIC device; FIG. 1B shows an image of an embodiment of an ion carpet on a printed circuit board, with the relative potentials of the ion carpet labelled; and FIG. 1C shows a perspective view of a TSIC device including an illustration of the flow of ions through a TSIC device.

FIGS. 2A and 2B illustrate the MS/MS spectra of quadrupole-selected singly-charged leucine enkephalin (YGGFL) monomer, wherein: FIG. 2A illustrates the spectra resulting from 35 eV SID using a TSIC SID device according to one embodiment of the present disclosure; and FIG. 2B illustrates the spectra resulting from 20 eV CID in a trap cell while the TSIC SID device (in place after the existing, truncated, CID "Trap" cell), was tuned for "flythrough" in which ions do not collide with the surface. In this experiment illustrating the influence of different effective collision target masses (SID vs CID), collision energies were chosen to approximately match precursor reduction rather than showing the same collision energy. SID experiments required analyte concentrations equal to and acquisition times comparable to CID.

FIGS. 3A-3D illustrate SID-ERMS (energy-resolved mass spectrometry) plots, wherein: FIG. 3A illustrates a result from an experiment using a 10-lens SID device and streptavidin 11+; FIG. 3B illustrates a result from an experiment using an embodiment of a TSIC SID device and streptavidin 11+; FIG. 3C illustrates a result from an experiment using a 10-lens SID device and CRP 18+ precursor; and FIG. 3D illustrates a result form an experiment using an embodiment of a TSIC SID device and CRP 18+ precursor.

FIGS. 4A-4D illustrate representative SID spectra generated using a TSIC SID device according to one embodiment of the present disclosure wherein: FIG. 4A illustrates representative SID spectra of streptavidin 11+ tetramer at an SID ΔV of 50V; FIG. 4B illustrates representative SID spectra of streptavidin 11+ tetramer at an SID ΔV of 100V; FIG. 4C illustrates representative SID spectra of C-reactive protein 18+ pentamer at an SID ΔV of 50V; FIG. 4D illustrates representative SID spectra of C-reactive protein 18+ pentamer at an SID ΔV of 100V. The collision energy is ΔV times the charge state of the precursor ion.

DETAILED DESCRIPTION

Figure 1A:
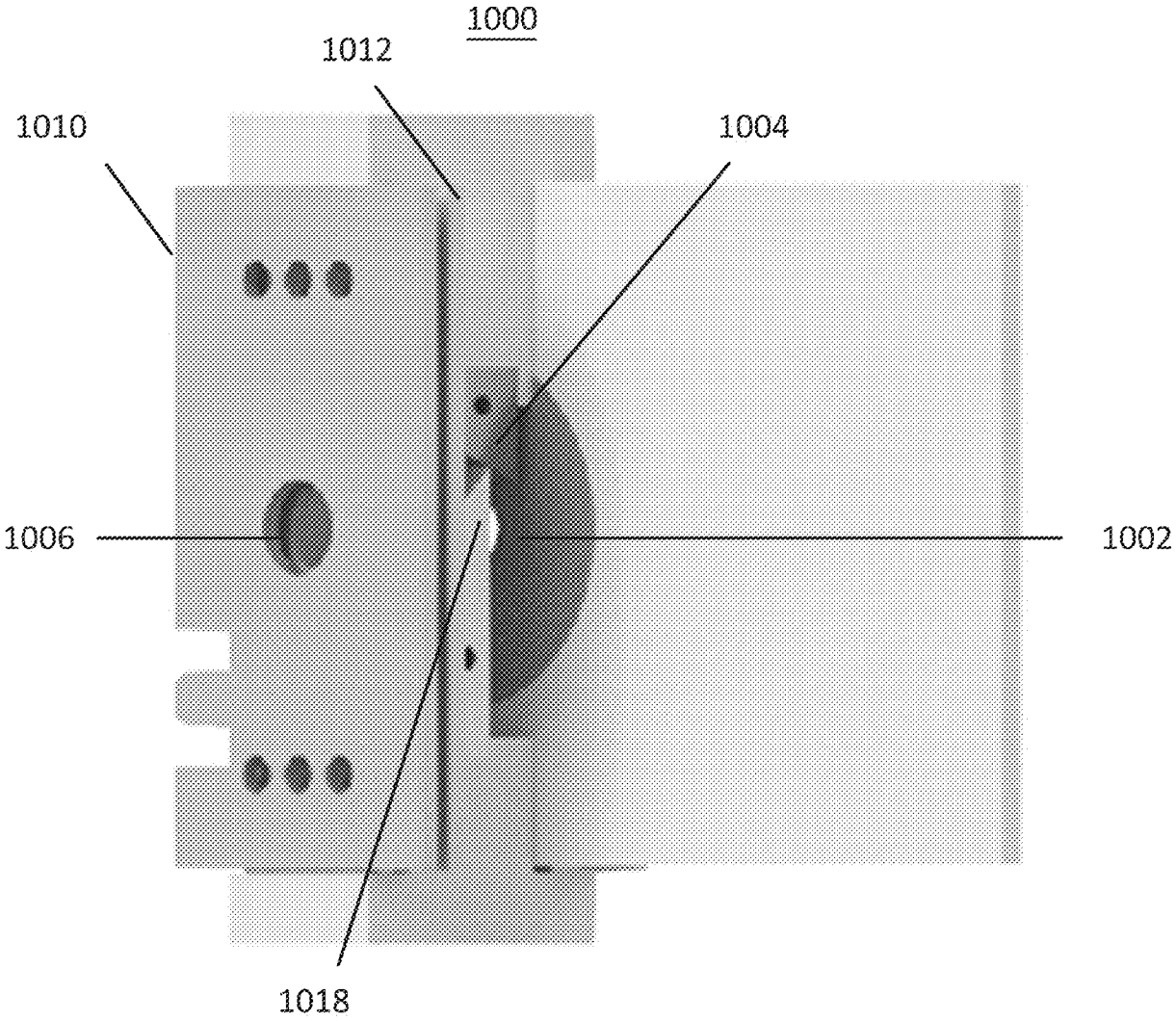

In some aspects, the present disclosure relates to surface-induced dissociation (SID) devices and methods. Although example embodiments of the present disclosure are explained in detail herein, it is to be understood that other embodiments are contemplated. Accordingly, it is not intended that the present disclosure be limited in its scope to the details of construction and arrangement of components set forth in the following description or illustrated in the drawings. The present disclosure is capable of other embodiments and of being practiced or carried out in various ways.

It must also be noted that, as used in the specification and the appended claims, the singular forms "a," "an" and "the" include plural referents unless the context clearly dictates otherwise. Certain values may be expressed in terms of ranges "from" one value "to" another value. When a range is expressed in terms of "from" a particular lower value "to" a particular higher value, or "from" a particular higher value "to" a particular lower value, the range includes the particular lower value and the particular higher value.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

In describing example embodiments, terminology will be resorted to for the sake of clarity. It is intended that each term contemplates its broadest meaning as understood by those skilled in the art and includes all technical equivalents that operate in a similar manner to accomplish a similar purpose. It is also to be understood that the mention of one or more steps of a method does not preclude the presence of additional method steps or intervening method steps between those steps expressly identified. Steps of a method may be performed in a different order than those described herein without departing from the scope of the present disclosure. Similarly, it is also to be understood that the mention of one or more components in a device or system does not preclude the presence of additional components or intervening components between those components expressly identified.

Some references, which may include various patents, patent applications, and publications, are cited in a reference list and discussed in the disclosure provided herein. The citation and/or discussion of such references is provided merely to clarify the description of the present disclosure and is not an admission that any such reference is "prior art" to any aspects of the present disclosure described herein. In terms of notation, "[n]" corresponds to the $n^{th}$ reference in the list. For example, "[3]" refers to the $3^{rd}$ reference in the list, namely Busch, F.; VanAernum, Z. L.; Ju, Y.; Yan, J.; Gilbert, J. D.; Quintyn, R. S.; Bern, M.; Wysocki, Vicki H. Localization of Protein Complex Bound Ligands by Surface-Induced Dissociation High-Resolution Mass Spectrometry. Analytical Chemistry 2018, 90, 12796-12801. All references cited and discussed in this specification are incorporated herein by reference in their entireties and to the same extent as if each reference was individually incorporated by reference.

A detailed description of aspects of the present disclosure, in accordance with various example embodiments, will now be provided with reference to the accompanying drawings. The drawings form a part hereof and show, by way of illustration, specific embodiments and examples. In referring to the drawings, like numerals represent like elements throughout the several figures. Some experimental data are presented herein for purposes of illustration and should not be construed as limiting the scope of the present disclosure in any way or excluding any alternative or additional embodiments.

In one embodiment of the present disclosure, an SID device utilizes 5 metal lenses and an "ion carpet" consisting of two independent voltages, giving a total of 7 independent voltages requiring tuning for operation. The "ion carpet" is a PCB consisting of 14 concentric rings, each of which are resistively linked to one another. A voltage can be applied to the outermost and innermost ring, creating a "planar funnel" on the surface of the PCB. All 7 voltages are tuned to move from "flythrough" (ion transmission through the device resulting in no collision with the surface or ion activation) to SID. Changing the energy of SID is accomplished by changing the acceleration at which ions hit the surface, which is accomplished by changing only two potentials in the SID device and one additional potential in the existing instrument software. In some embodiments, optimized dimensions have been developed for an angled deflector lens that consists of a semicircle, angled cutaway to guide ions up to the angled surface; this design incorporates an angled surface compared with, for example, an existing 10-lens device, and includes the "ion carpet" PCB immediately following the surface to help guide and focus ions back to the original ion path following a collision with the surface.

In accordance with some embodiments, the decrease in total number of DC voltages (and therefore fewer power supplies) is advantageous because it allows for simpler integration within a commercial instrument and is easier to tune because of the decreased number of lenses and more intuitive layout. This allows for increased end-product usability when used by non-experts. Some SID devices according to these embodiments can decrease the amount of time spent tuning for everyday use, regardless of the size of the sample.

The increased sensitivity of devices and related methods in accordance with the present disclosure are advantageous when working with samples that have limited ion abundance, as is often the case with "real world" protein complex samples. Multiple installations in different instruments have shown devices according to some embodiments of the present disclosure to be robust and to provide consistent results from install to install. Also, the length of certain embodiments is 1.6 cm (compared with 3 cm for an example existing design). This smaller axial footprint allows for incorporation into an existing mass spectrometry platform with less modification or with a new platform with a smaller overall footprint. The smaller surface-to-exit distance can lead to higher collection efficiency, as the surface-to-exit of some embodiments of the present disclosure is smaller than that of existing devices. This can lead to less ion beam broadening without confining RF and subsequently less ion loss. This significant decrease in size allows for some embodiments to be adapted across a greater number of commercial instrument platforms, as not every instrument has, e.g., 3 cm to spare.

Some embodiments described herein can effectively fragment both high and low m/z ions, where m is the ion mass, and z is the precursor charge. According to some embodiments of the present disclosure, "low m/z" ions include peptides, while "high m/z" ions include protein complexes. Ions that are not fragmented may be described as "precursor ions." In some embodiments of the present disclosure, the precursor ions comprise small molecules, lipids, fatty acids, peptides, sugars, metabolites, oligomers, nucleotides, polymers, natural or designed and synthetic variants of the molecular classes. In some embodiments of the present disclosure, the precursor ions correspond to proteins, protein complexes, protein-small molecule complexes, RNA, DNA, protein-RNA complexes, protein-DNA complexes, lipid nanodiscs, antibodies, antibody-drug conjugates, DNA complexes, RNA complexes, viruses, fungi, or bacteria.

Figure 1B:
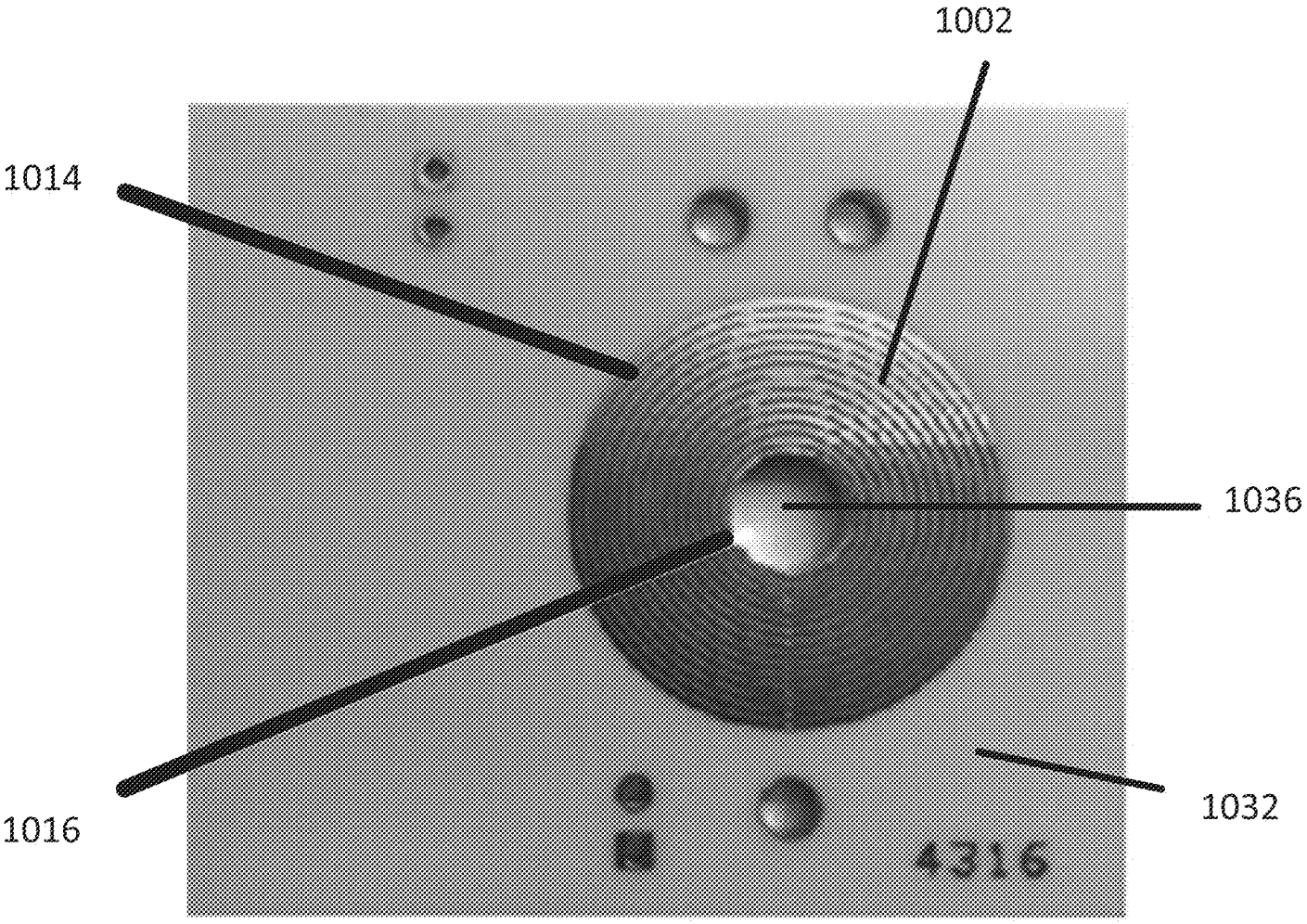
Figure 1C:
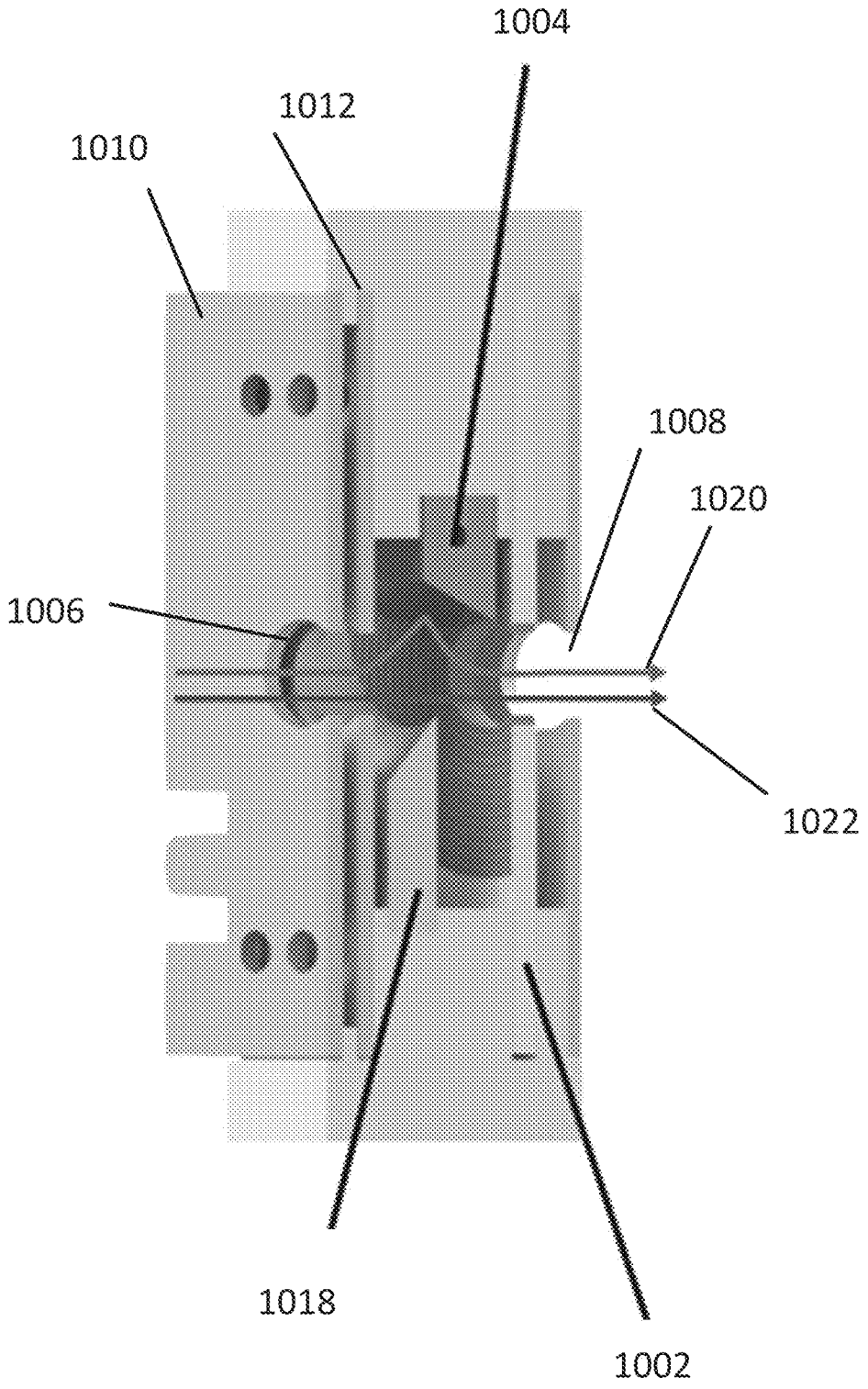

FIGS. 1A-1C show schematics and components of a device implementing a tilted surface with ion carpet (TSIC) in accordance with one embodiment of the present disclosure, wherein: FIG. 1A shows a perspective view of a TSIC device 1000; FIG. 1B shows an image of an embodiment of an ion carpet 1002 on a printed circuit board 1032, with the relative potentials of the ion carpet 1002 labelled; and FIG. 1C shows a perspective view of a TSIC device including an illustration of the flow of ions through a TSIC device. With reference to FIG. 1A, a perspective view of an embodiment of the device 1000 is depicted. Ions enter the device 1000 through entrance 1006. The entrance 1006 comprises a first entrance lens 1010 and a second entrance lens 1012. When the device 1000 is operated in SID mode, the angled deflector lens 1018 directs ions toward the surface 1004, causing SID. The ion carpet 1002 then guides the product ions through the exit of the device 1008 (not shown in FIG. 1A).

With reference to FIG. 1B a first potential and second potential are applied to the ion carpet 1002. The first potential is applied to the outer ring electrode 1014 and the second potential is applied to the inner ring electrode 1016. The ion carpet 1002 is comprised of rings, separated by resistances. The potential difference between the outer ring electrode 1014 and the inner ring electrode 1016 therefore causes a gradient of voltages between the rings of the ion carpet 1002. According to some embodiments of the present disclosure, an ion carpet 1002 array comprises a printed circuit board 1032 with concentric ring electrodes that are resistively coupled to one another in series to create an effective "planar funnel," guiding ions towards the center aperture 1036 opening.

The embodiment of the ion carpet 1002 shown in FIG. 1B is comprised of a printed circuit board (PCB) 1032 containing 14 concentric ring electrodes with 0.13 mm spacing between each ring and a 5 mm exit opening 1036. The electrodes are resistively linked to one another in series as shown in FIG. 1B allowing for a voltage gradient to form when the outermost ring electrode 1014 and innermost ring electrode 1016 are supplied with external DC voltage. This embodiment of the ion carpet 1002 was fabricated with a ceramic base and gold-plated copper electrodes. Top and bottom brackets, which hold all electrodes and the ion carpet 1002 in place, were constructed from polyether ether ketone (PEEK). The surface electrode in this embodiment is made from polished stainless steel and the remaining electrodes were fabricated from aluminum.

Some embodiments of the present disclosure use a DC-only ion carpet array to collect product fragments following surface collisions of small peptides and protein complexes within an SID device. Some embodiments of the present disclosure are optimized for native mass spectrometry applications.

With reference to FIG. 1C, illustrations of the ion path in SID mode 1020 and the ion path in flythrough mode 1022 are shown. In SID mode, the ions enter through the entrance 1006 which is comprised of a first entrance lens 1010 and a second entrance lens 1012. The angled deflector lens 1018 directs the path of the ions 1020 toward collision surface 1004. The product ions are then directed toward exit 1008 by the ion carpet 1002. In flythrough mode, the angled deflector lens 1018 does not direct ions toward the surface 1004. Ions pass through the entrance 1006 and continue through to the exit 1008 without colliding with the surface 1004.

Figure 2A:
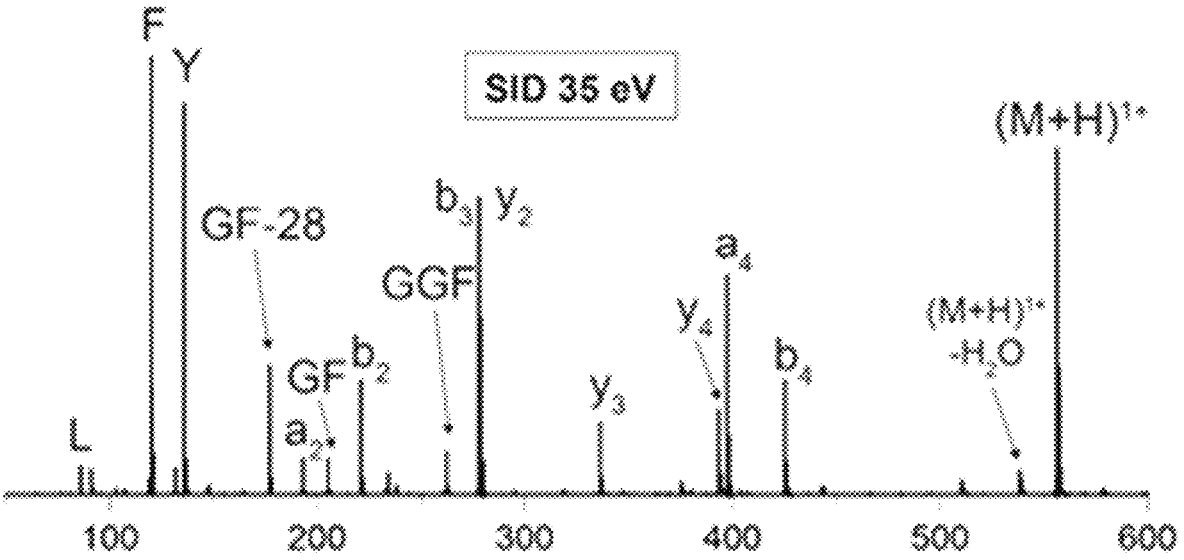
Figure 2B:
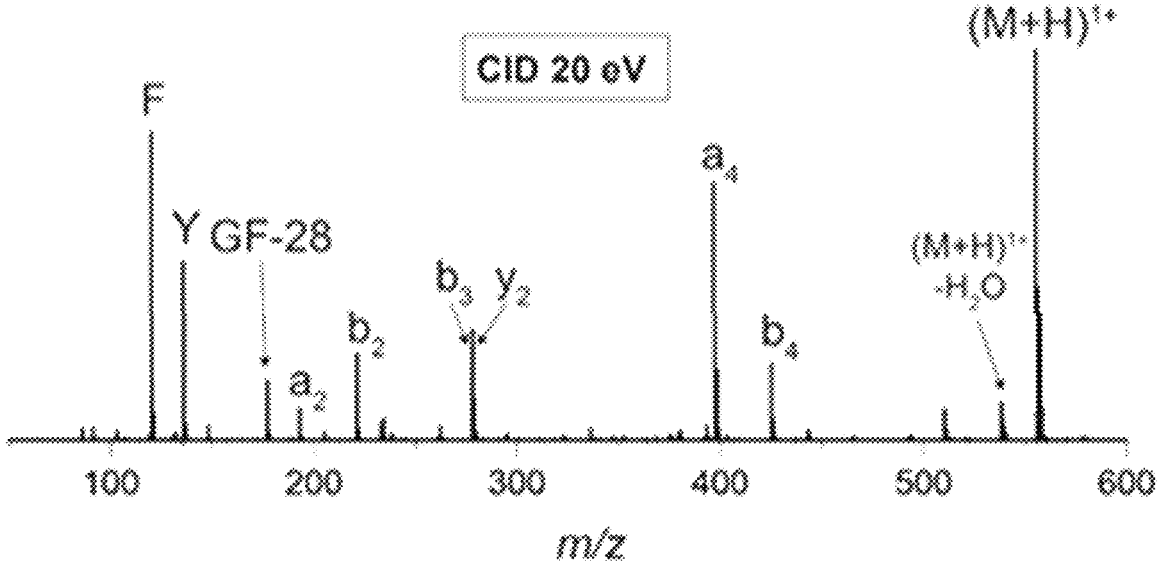

FIGS. 2A-2B illustrate the spectra of quadrupole-selected, singly-protonated leucine enkephalin (YGGFL) monomer fragmented with either SID or CID, both while the TSIC SID device was installed in the mass spectrometer, wherein: FIG. 2A illustrates the spectra resulting from 35 eV SID using a TSIC SID device according to one embodiment of the present disclosure; and FIG. 2B illustrates the spectra resulting from 20 eV CID in the trap cell immediately preceding the TSIC SID device, as controlled by the original instrument software, with the TSIC SID device tuned for flythrough. In this experiment illustrating the influence of different effective target masses (surface vs gas), collision energies were chosen to approximately match precursor reduction rather than showing the same collision energy. SID experiments required analyte concentrations equal to and acquisition times comparable to CID. The SID device embodiments used in the experiment reflected in the data in FIGS. 2A and 2B used a stainless steel surface. Other surface materials may be used, alternatively, including gold, glass, gold plating, and fluorinated self-assembled monolayers. The SID devices used to generate the data shown in FIGS. 2A and 2B were installed in a Waters SYNAPT G2 Q-IM-TOF mass spectrometer although other vendors' mass spectrometers would be appropriate for placement of an SID device.

Figure 3A:
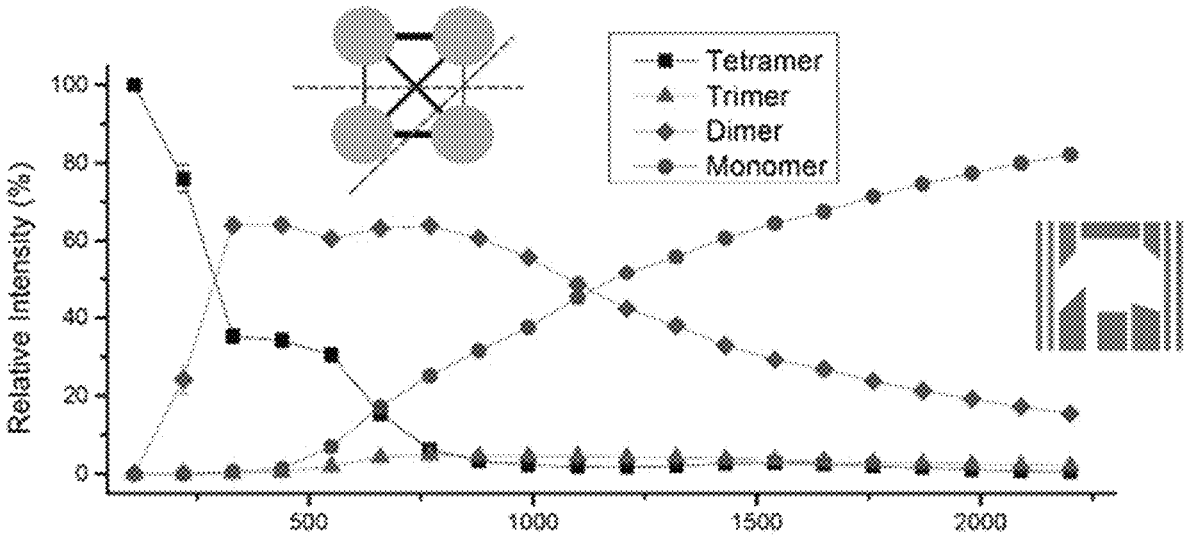
Figure 3B:
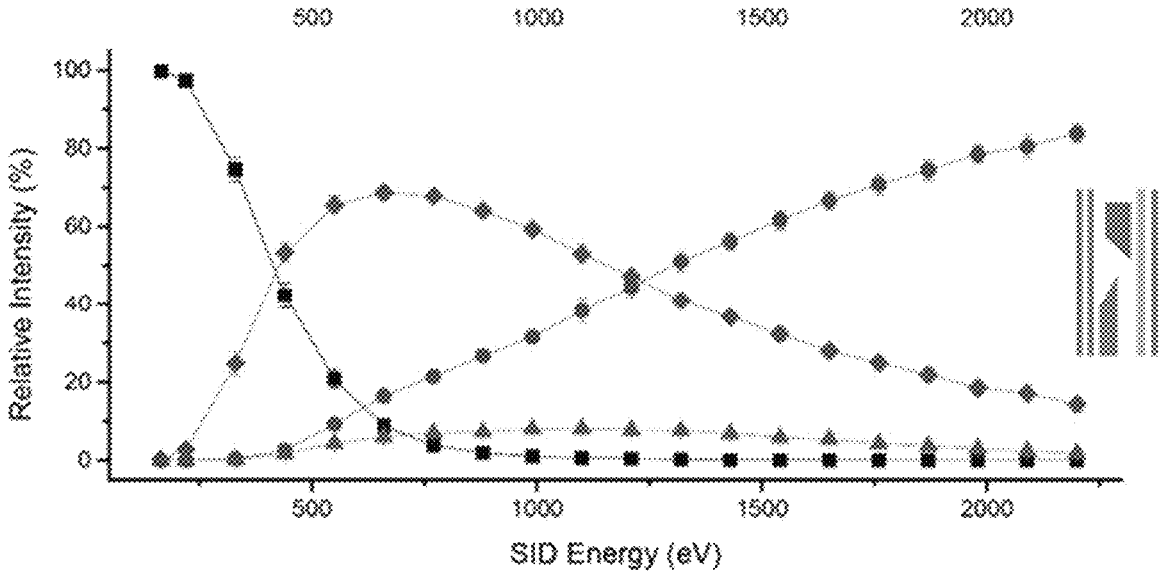
Figure 3C:
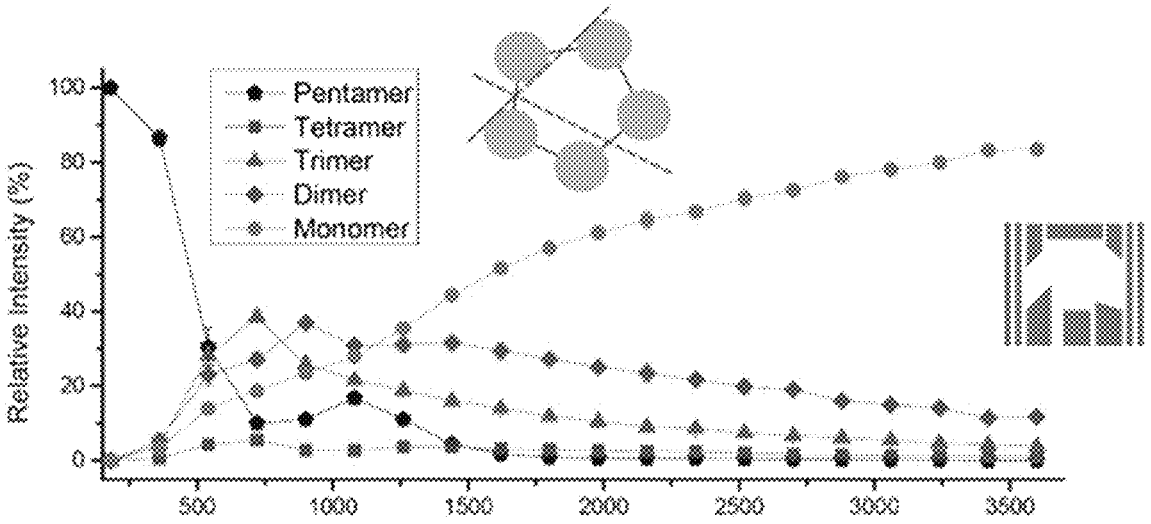
Figure 3D:
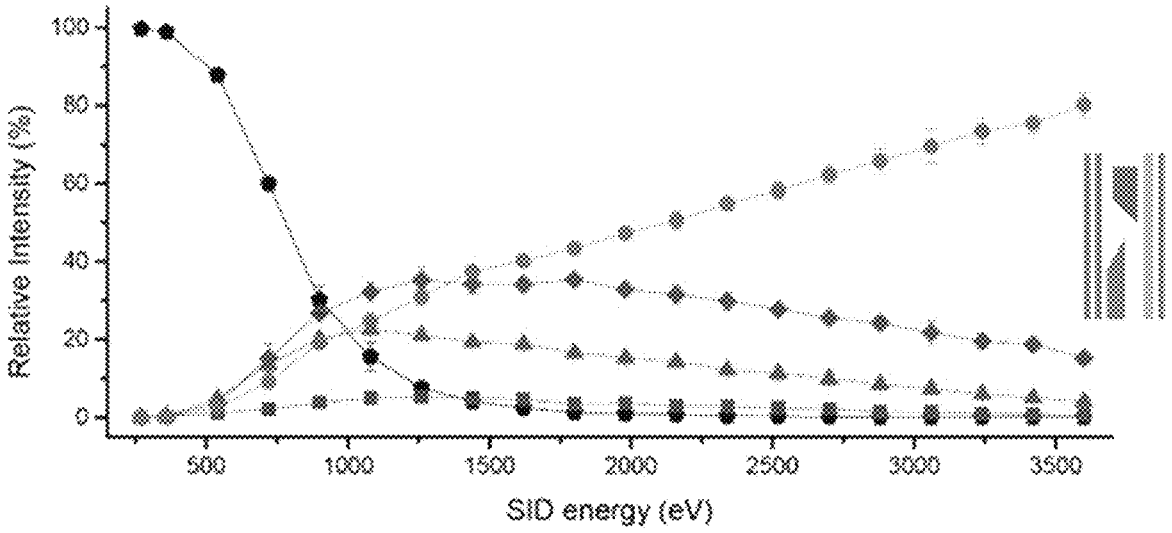

FIGS. 3A-3D illustrate SID-ERMS (energy-resolved mass spectrometry) plots, wherein: FIG. 3A illustrates a result from an experiment using a 10-lens SID device and streptavidin 11+ precursor; FIG. 3B illustrates a result from an experiment using an embodiment of a TSIC SID device and streptavidin 11+ precursor; FIG. 3C illustrates a result from an experiment using a 10-lens SID device and CRP 18+ precursor; and FIG. 3D illustrates a result form an experiment using an embodiment of a TSIC SID device and CRP 18+ precursor. The combination of ion mobility following SID enables determination of the relative intensities of each subcomplex or subunit at a specific energy without the requirement of isotopic resolution although SID is effective for dissociation whether or not it is coupled with ion mobility. The relative abundance of each subcomplex can be shown as a function of SID energy in energy-resolved mass spectrometry (ERMS) plots, as displayed for streptavidin (53 kDa homotetramer) and C-reactive protein (CRP; 115 kDa homopentamer) in FIG. 3. The definition of ΔV for SID energy (lab frame collision energy=charge times ΔV) remained constant when comparing the two devices, but the surface collision angle, voltage of the angled deflector lens used to push ions to the surface, efficacy of product ion collection, and especially pressure in the region post-surface collision contribute to slightly different effective SID energies for each device. Despite identical placement of both devices (original 10-lens device and TSIC device) within the instrument, the shorter dimension of the embodiment including a TSIC results in a surface and post-surface region much closer to the entrance of the helium cell, and subsequent effects from gas flow and increased pressure.

From these plots, the TSIC SID device shows a shallower onset between precursor and products in the low-energy regime. Analysis of the ion mobiligrams observed from these experiments on streptavidin and CRP indicate folded, native-like products with symmetric charge partitioning, aligning with previously-published data on SID of these proteins. According to some embodiments of the present disclosure, the tune settings used within the TSIC device remained constant in the energy range determined by ΔV=10 V to 200 V between experiments with peptides and protein complexes. For the ion current resulting from collisions of protein complexes in the TSIC SID device, characteristic SID products are still clearly observed with high S/N.

Figure 4C:
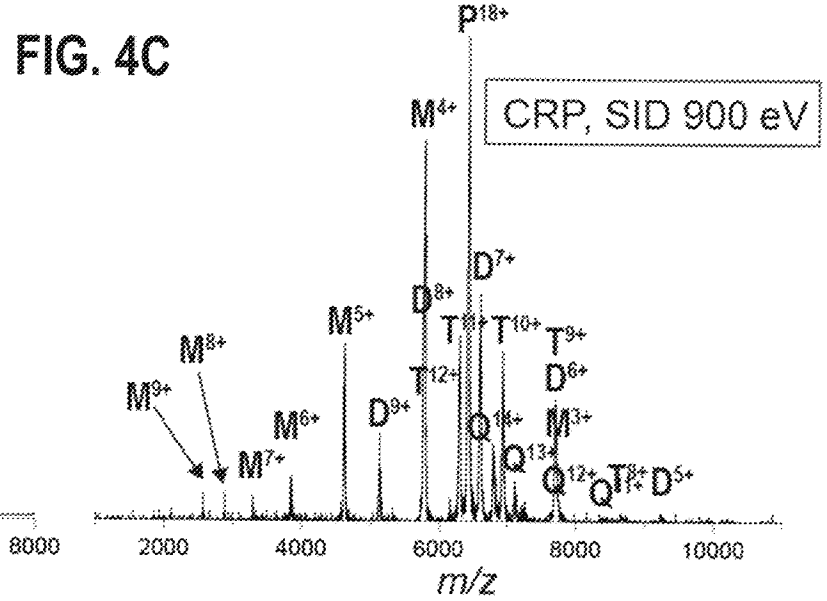
Figure 4D:
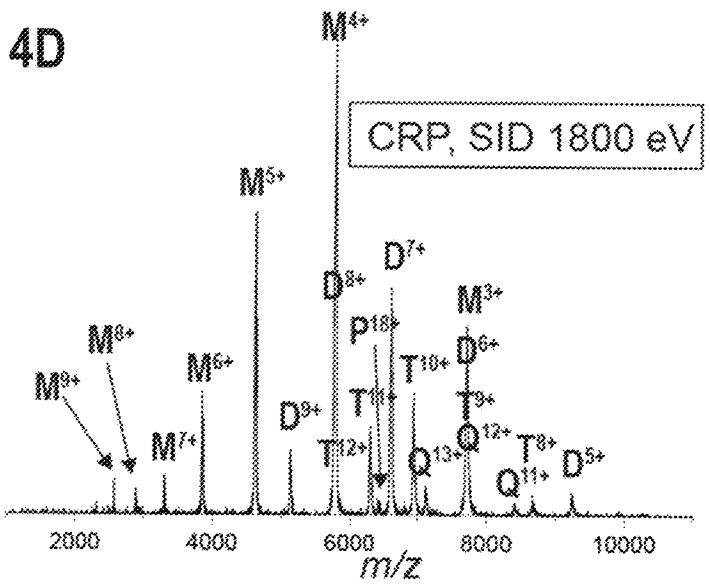
Figure 4A:
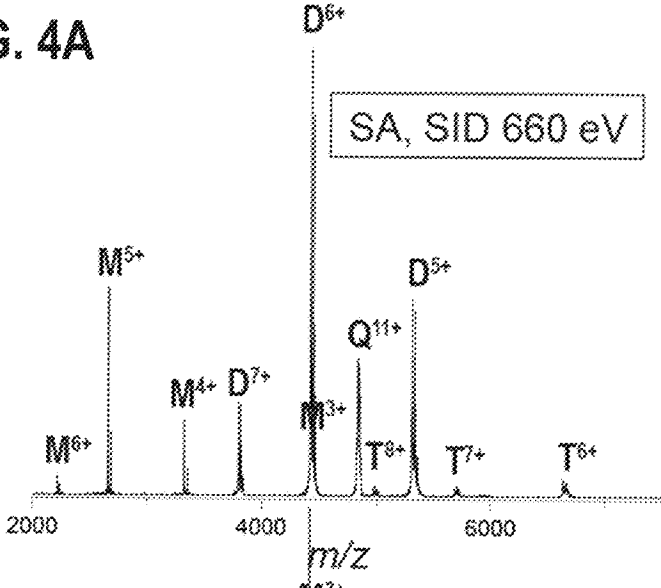
Figure 4B:
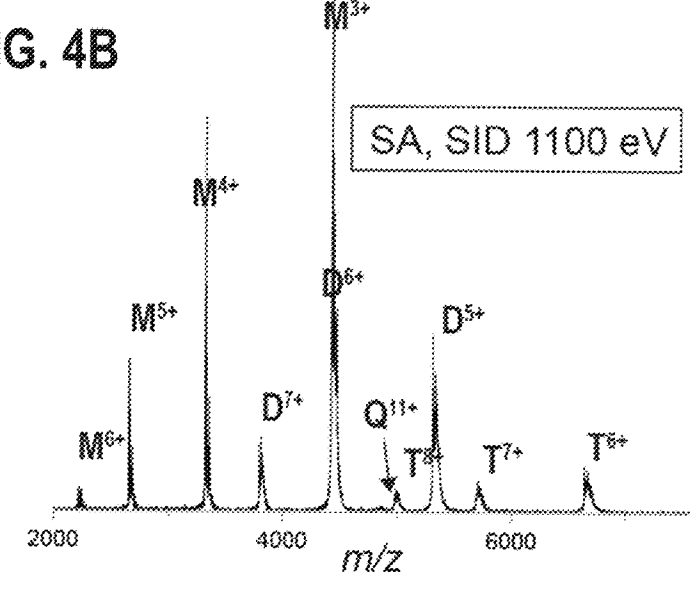

FIGS. 4A-4D illustrate representative SID spectra generated using a TSIC SID device according to one embodiment of the present disclosure, wherein: FIG. 4A illustrates representative SID spectra of streptavidin 11+ tetramer at an SID ΔV of 50V; FIG. 4B illustrates representative SID spectra of streptavidin 11+ tetramer at an SID ΔV of 100V; FIG. 4C illustrates representative SID spectra of C-reactive protein 18+ pentamer at an SID ΔV of 50V; and FIG. 4D illustrates representative SID spectra of C-reactive protein 18+ pentamer at an SID ΔV of 100V. In FIGS. 4A-4D, "M" corresponds to monomers, "D" to dimers, "T" to trimers, "Q" to tetramers, and "P" to pentamers. The SID ΔV shown in FIGS. 4A-4D is defined as the difference in potential between the exit of the trap cell and the surface within the SID device. The SID devices used to generate FIGS. 4A-4D were installed in a SYNAPT G2 Q-IM-TOF mass spectrometer.

According to some embodiments of the present disclosure, the SID energy may be adjusted by increasing the acceleration of the ions into the SID device along with adjusting the potential voltages on the first entrance lens and the angled deflector lens.

Some embodiments of the TSIC device require fewer independent voltages than other devices to accomplish SID. According to some embodiments of the present disclosure, only 7 independent voltages are required to accomplish SID. Some embodiments of the TSIC device are smaller than other SID devices as measured along the ion path. According to some embodiments of the present disclosure, the size of the SID device may be 1.6 cm or less as measured along the ion path. Some embodiments of the present disclosure are suitable for installation into a broad range of commercial mass spectrometers. For example, some embodiments of the present disclosure are suitable for installation in a SYNAPT G2 Q-IM-TOF mass spectrometer. According to some embodiments of the present disclosure, the SID device can be configured to a "flythrough" mode in which ions do not collide with the surface, allowing for normal operation of the mass spectrometer containing the device.

Some embodiments of the present disclosure can be configured for fragmenting a wide range of precursors values with the same tuning settings. According to some embodiments of the present disclosure, simulation data may be used to guide tuning of the device.

The various embodiments described above are provided by way of illustration only and should not be construed to limit the scope of the present disclosure. The patentable scope of certain embodiments of the present disclosure is indicated by the appended claims, rather than the foregoing description, and all changes that come within the meaning and range of equivalents thereof are intended to be embraced therein.

LIST OF REFERENCES

[1] Robinson, C. V.; Sali, A.; Baumeister, W. The Molecular Sociology of the Cell. *Nature* 2007, 450 (7172), 973-982. https://doi.org/10.1038/nature06523.

[2] Sharon, M. How Far Can We Go with Structural Mass Spectrometry of Protein Complexes? *J Am Soc Mass Spectrom* 2010, 21 (4), 487-500. https://doi.org/10.1016/j.jasms.2009.12.017.

[3] Busch, F.; VanAernum, Z. L.; Ju, Y.; Yan, J.; Gilbert, J. D.; Quintyn, R. S.; Bern, M.; Wysocki, Vicki H. Localization of Protein Complex Bound Ligands by Surface-Induced Dissociation High-Resolution Mass Spectrometry. *Analytical Chemistry* 2018, 90, 12796-12801.

[4] Benesch, J. L. P.; Robinson, C. V. Mass Spectrometry of Macromolecular Assemblies: Preservation and Dissociation. *Curr. Opin. Struct. Biol.* 2006, 16, 245-251.

[5] Niu, S.; Ruotolo, B. T. Collisional Unfolding of Multiprotein Complexes Reveals Cooperative Stabilization upon Ligand Binding. *Protein Sci* 2015, 24 (8), 1272-1281. https://doi.org/10.1002/pro.2699.

[6] Quintyn, R. S.; Yan, J.; Wysocki, V. H. Surface-Induced Dissociation of Homotetramers with D2 Symmetry Yields Their Assembly Pathways and Characterizes the Effect of Ligand Binding. *Chem. Biol.* 2015, 22, 583-592.

[7] Postawa, Z.; Czerwinski, B.; Szewczyk, M.; Smiley, E. J.; Winograd, N.; Garrison, B. J. Enhancement of Sputtering Yields Due to C60 versus Ga Bombardment of Ag{111} As Explored by Molecular Dynamics Simulations. *Anal. Chem.* 2003, 75 (17), 4402-4407. https://doi.org/10.1021/ac034387a.

[8] Meroueh, O.; Hase, W. L. Dynamics of Energy Transfer in Peptide-Surface Collisions. *J. Am. Chem. Soc.* 2002, 124 (7), 1524-1531. https://doi.org/10.1021/ja011987n.

[9] Pratihar, S.; Barnes, G. L.; Laskin, J.; Hase, W. L. Dynamics of Protonated Peptide Ion Collisions with Organic Surfaces: Consonance of Simulation and Experiment. *J. Phys. Chem. Lett.* 2016, 7 (16), 3142-3150. https://doi.org/10.1021/acs.jpclett.6b00978.

[10] Williams, E. R.; Fang, L.; Zare, R. N. Surface Induced Dissociation for Tandem Time-of-Flight Mass Spectrometry. *International Journal of Mass Spectrometry and Ion Processes* 1993, 123, 233-241.

[11] Laskin, J.; Futrell, J. H. Energy Transfer in Collisions of Peptide Ions with Surfaces. *J. Chem. Phys.* 2003, 119 (6), 3413-3420. https://doi.org/10.1063/1.1589739.

[12] Dongre, A. R.; Jones, J. L.; Somogyi, A.; Wysocki, Vicki H. Influence of Peptide Composition, Gas-Phase Basicity, and Chemical Modification on Fragmentation Efficiency: Evidence for the Mobile Proton Model. *J. Am. Chem. Soc.* 1996, 118 (35), 8365-8374.

[13] Harvey, S. R.; Seffernick, J. T.; Quintyn, R. S.; Song, Y.; Ju, Y.; Yan, J.; Sahasrabuddhe, A. N.; Norris, A.; Zhou, M.; Behrman, E. J.; et al. Relative Interfacial Cleavage Energetics of Protein Complexes Revealed by Surface Collisions. *Proc Natl Acad Sci USA* 2019, 116 (17), 8143-8148. https://doi.org/10.1073/pnas.1817632116.

[14] Zhou, M.; Dagan, S.; Wysocki, V. H. Protein Subunits Released by Surface Collisions of Noncovalent Complexes: Nativelike Compact Structures Revealed by Ion Mobility Mass Spectrometry. *Angew. Chem.* 2012, 124 (18), 4412-4415. https://doi.org/10.1002/ange.201108700.

[15] Anthony, S. N.; Shinholt, D. L.; Jarrold, M. F. A Simple Electrospray Interface Based on a DC Ion Carpet. *International Journal of Mass Spectrometry* 2014, 371, 1-7. https://doi.org/10.1016/j.ijms.2014.06.007.

[16] VanAernum, Z. L.; Gilbert, J. D.; Belov, M. E.; Makarov, A. A.; Horning, S. R.; Wysocki, Vicki H. Surface-Induced Dissociation of Noncovalent Protein Complexes in an Extended Mass Range Orbitrap Mass Spectrometer. *Analytical Chemistry* 2019, 91, 3611-3618. https://doi.org/10.1021/acs.analchem.8b05605.

[17] Galhena, A. S.; Dagan, S.; Jones, C. M.; Beardsley, R. L.; Wysocki, V. H. Surface-Induced Dissociation of Peptides and Protein Complexes in a Quadrupole/Time-of-Flight Mass Spectrometer. *Anal. Chem.* 2008, 80, 1425-1436.

[18] Yan, J.; Zhou, M.; Gilbert, J. D.; Wolff, J. J.; Somogyi, A.; Pedder, R. E.; Quintyn, R. S.; Morrison, L. J.; Easterling, M. L.; Pasa-Tolić, L.; et al. Surface-Induced Dissociation of Protein Complexes in a Hybrid Fourier Transform Ion Cyclotron Resonance Mass Spectrometer. *Anal. Chem.* 2017, 89, 895-901.

[19] Shirzadeh, M.; Boone, C. D.; Laganowsky, A.; Russell, D. H. Topological Analysis of Transthyretin Disassembly Mechanism: Surface-Induced Dissociation Reveals Hidden Reaction Pathways. *Anal. Chem.* 2019, 91 (3), 2345-2351. https://doi.org/10.1021/acs.analchem.8b05066.

[20] Vimer, S.; Ben-Nissan, G.; Morgenstern, D.; Quintyn, R. S.; Wysocki, V. H.; Sharon, M. Multilevel Analysis of Ortholog Protein Complexes by Native Mass Spectrometry. *Manuscript submitted.*

[21] Wang, Y.; Hase, W. L.; Song, K. Direct Dynamics Study of N-Protonated Diglycine Surface-Induced Dissociation. Influence of Collision Energy. *J Am Soc Mass Spectrom* 2003, 14 (12), 1402-1412. https://doi.org/10.1016/j.jasms.2003.08.014.

[22] Jo, S.-C.; Cooks, R. G. Translational to Vibrational Energy Conversion during Surface-Induced Dissociation of n-Butylbenzene Molecular Ions Colliding at Self-Assembled Monolayer Surfaces. *Eur J Mass Spectrom* (*Chichester*) 2003, 9 (4), 237-234. https://doi.org/10.1255/ejms.554.

[23] Snyder, D. T.; Panczyk, E.; Stiving, A. Q.; Gilbert, J. D.; Somogyi, A.; Kaplan, D.; Wysocki, V. H. Design and Performance of a Second-Generation Surface-Induced Dissociation Cell for Fourier Transform Ion Cyclotron Resonance Mass Spectrometry of Native Protein Complexes. *Analytical Chemistry*. https://doi.org/10.1021/acs.analchem.9b03746.

What is claimed is:

1. A device for surface-induced dissociation (SID), comprising:

an entrance configured to receive ions;

a deflector configured such that when the device is selectively operating in an SID mode, electrical properties are selectively applied to the deflector and the deflector guides the ions entering through the entrance to a collision surface to cause SID, and wherein the electrical properties are selected to repel the ions from the deflector towards the collision surface and/or attract the ions towards the collision surface; and an ion carpet configured such that when the device is operating in the SID mode, electrical properties are selectively applied to the ion carpet and the ion carpet guides product ions resulting from collision with the collision surface to a post-SID region, wherein the ion carpet comprises a plurality of concentric rings defining a central opening through which the guided product ions exit the device, wherein the deflector is configured to fragment high m/z ions and low m/z ions, and wherein the ion carpet is configured to collect fragments form the high m/z ions and the low m/z ions, wherein the entrance, deflector, collision surface, and ion carpet are arranged to define an ion path such that:

in the SID mode, the ions are configured to collide with the collision surface and undergo SID, and the product ions are guided by the ion carpet to the post-SID region and exit through the central opening, and in a flythrough mode, the ions are configured to travel through the entrance, pass the deflector and collision surface, and exit through the central opening without undergoing SID.

2. The device of claim 1, wherein the plurality of concentric rings of the ion carpet include an outermost ring having a first selected direct current (DC) voltage and an innermost ring having a second, different selected DC voltage, to generate a voltage gradient and guide the product ions to the post-SID region, wherein the plurality of concentric rings are resistively coupled.

3. The device of claim 1, wherein the deflector is an angled deflector lens.

4. The device of claim 3, wherein the angled deflector lens is configured with at least a portion thereof having a semicircular shape.

5. The device of claim 1, wherein the ions correspond to small molecules, lipids, fatty acids, peptides, sugars, metabolites, oligomers, nucleotides, polymers, or natural or designed and synthetic variants of the molecular classes.

6. The device of claim 1, wherein the ions correspond to proteins, protein complexes, protein-small molecule complexes, RNA, DNA, protein-RNA complexes, protein-DNA complexes, lipid nanodiscs, antibodies, antibody-drug conjugates, DNA complexes, RNA complexes, viruses, fungi, or bacteria.

7. A device for surface-induced dissociation (SID), comprising:

an entrance lens configured to receive precursor ions;

an angled deflector lens configured such that when the device is selectively operating in an SID mode, electrical properties are selectively applied to the angled deflector lens and the angled deflector lens guides the precursor ions entering through the entrance lens to a tilted collision surface to cause SID, and wherein the electrical properties are selected to repel the ions from the angled deflector lens towards the collision surface and/or attract the ions towards the collision surface;

an ion carpet, having a plurality of resistively coupled rings configured such that when the device is operating in the SID mode, the ion carpet has an applied direct current (DC) voltage gradient and is configured to guide product ions resulting from collision with the collision surface to a post-SID region, wherein the ion carpet comprises a plurality of concentric rings defining a central opening through which the guided product ions exit the device;

wherein the angled deflector lens is configured to fragment high m/z ions and low m/z ions, and wherein the ion carpet is configured to collect fragments from the high m/z and the low m/z ions, and wherein the entrance lens, angled deflector lens, collision surface, and ion carpet are arranged to define an ion path such that:

in the SID mode, the ions are configured to collide with the collision surface and undergo SID, and the product ions are guided by the ion carpet to the post-SID region and exit through the central opening, and in a flythrough mode are configured to, the ions travel through the entrance lens, pass the angled deflector lens and collision surface, and exit through the central opening without undergoing SID.

8. The device of claim 7, wherein the plurality of resistively coupled rings of the ion carpet comprise the concentric rings, and wherein the concentric rings include an outermost ring having a first selected direct current (DC) voltage and an innermost ring having a second, different selected DC voltage, to generate the voltage gradient and guide the product ions to the post-SID region.

9. The device of claim 7, wherein the angled deflector lens is configured with at least a portion thereof having a semicircular shape.

10. The device of claim 7, wherein the ions correspond to small molecules, lipids, fatty acids, peptides, sugars, metabolites, oligomers, nucleotides, polymers, or natural or designed and synthetic variants of the molecular classes.

11. The device of claim 7, wherein the ions correspond to proteins, protein complexes, protein-small molecule complexes, RNA, DNA, protein-RNA complexes, protein-DNA complexes, lipid nanodiscs, antibodies, antibody-drug conjugates, DNA complexes, RNA complexes, viruses, fungi, or bacteria.

12. A method for surface-induced dissociation (SID), comprising:

guiding, by a deflector configured to selectively operate in an SID mode where electrical properties are selectively applied to the deflector to guide ions to a collision surface to cause SID, entering ions to a collision surface to cause the SID, wherein the electrical properties are selected to repel the ions from the deflector towards the collision surface and/or attract the ions towards the collision surface, and wherein the deflector is an angled deflector lens configured with at least a portion thereof having a semicircular shape;

wherein the deflector is configured to fragment high m/z ions and low m/z ions;

guiding, by an ion carpet having selectively applied electrical properties, product ions resulting from collision with the collision surface to a post-SID region wherein the ion carpet comprises a plurality of concentric rings defining a central opening through which the guided product ions exit and wherein the ion carpet is configured to collect fragments from the high m/z ions and the low m/z ions;

configuring the deflector and ion carpet to operate in a flythrough mode;

and guiding, entering ions past the deflector and collision surface to exit through the central opening without undergoing SID.

13. The method of claim 12, wherein the plurality of concentric rings includes an outermost ring and an innermost ring, and wherein the method comprises applying a first selected direct current (DC) voltage to the outermost ring and applying a second, different selected DC voltage to generate a voltage gradient, and wherein the plurality of concentric rings are resistively coupled.

14. The method of claim 12, wherein the ions correspond to small molecules, lipids, fatty acids, peptides, sugars, metabolites, oligomers, nucleotides, polymers, or natural or designed and synthetic variants of the molecular classes.

15. The method of claim 12, wherein the ions correspond to proteins, protein complexes, protein-small molecule complexes, RNA, protein-RNA complexes, protein-DNA complexes, lipid nanodiscs, antibodies, antibody-drug conjugates, DNA complexes, RNA complexes, viruses, fungi, or bacteria.

* * * * *